US008408683B2

(12) United States Patent
Gerner et al.

(10) Patent No.: US 8,408,683 B2
(45) Date of Patent: Apr. 2, 2013

(54) METHOD OF REMOVING THERMOSET POLYMER FROM PIEZOELECTRIC TRANSDUCERS IN A PRINT HEAD

(75) Inventors: Bradley J. Gerner, Penfield, NY (US); John R. Andrews, Fairport, NY (US); Bryan R. Dolan, Rochester, NY (US); Pinyen Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/439,470

(22) Filed: Apr. 4, 2012

(65) Prior Publication Data

US 2012/0186739 A1 Jul. 26, 2012

Related U.S. Application Data

(62) Division of application No. 12/638,582, filed on Dec. 15, 2009, now Pat. No. 8,197,037.

(51) Int. Cl.
*B41J 2/045* (2006.01)
*B21D 53/00* (2006.01)

(52) U.S. Cl. ..... 347/71; 29/890.01

(58) Field of Classification Search ..... 347/68–72; 400/124.14, 124.16; 310/311, 324, 327, 310/365; 29/890.01, 890.1
See application file for complete search history.

(56) References Cited

U.S. PATENT DOCUMENTS

| | | | | |
|---|---|---|---|---|
| 4,877,644 | A | 10/1989 | Wu et al. | |
| 5,182,230 | A | 1/1993 | Donelon et al. | |
| 5,418,349 | A | 5/1995 | Swain et al. | |
| 5,643,472 | A | 7/1997 | Engelsberg et al. | |
| 6,054,012 | A | 4/2000 | Lowry | |
| 6,335,208 | B1 | 1/2002 | Lowry | |
| 6,488,367 | B1 * | 12/2002 | Debesis et al. | 347/70 |
| 6,602,790 | B2 | 8/2003 | Kian et al. | |
| 6,838,038 | B2 | 1/2005 | Lovell et al. | |
| 6,844,623 | B1 | 1/2005 | Peterson et al. | |
| 6,917,011 | B2 | 7/2005 | Hong et al. | |
| 6,956,283 | B1 | 10/2005 | Peterson | |
| 7,166,186 | B2 | 1/2007 | Lowry | |
| 7,316,936 | B2 | 1/2008 | Lowry | |
| 7,442,559 | B2 | 10/2008 | Auburger et al. | |
| 7,525,065 | B2 | 4/2009 | Engler et al. | |
| 7,766,463 | B2 * | 8/2010 | Stephens et al. | 347/71 |
| 8,006,356 | B2 * | 8/2011 | Andrews et al. | 29/25.35 |
| 2006/0049548 | A1 | 3/2006 | Auburger et al. | |
| 2009/0212292 | A1 | 8/2009 | Hayton et al. | |

* cited by examiner

*Primary Examiner* — Kristal Feggins
(74) *Attorney, Agent, or Firm* — Maginot, Moore & Beck, LLP

(57) ABSTRACT

A method for mounting a piezoelectric transducer layer to a diaphragm layer exposes an electrode for each piezoelectric transducer after thermoset polymer filling the interstitial space between the piezoelectric transducers has been cured. The method includes bonding a polymer layer to a diaphragm layer having a plurality of openings, bonding piezoelectric transducers to the diaphragm layer, filling areas between the piezoelectric transducers on the diaphragm layer with thermoset polymer, and removing the thermoset polymer from the piezoelectric transducers with a laser to expose a metal electrode on each piezoelectric transducer.

16 Claims, 4 Drawing Sheets

METHOD OF REMOVING THERMOSET POLYMER FROM PIEZOELECTRIC TRANSDUCERS IN A PRINT HEAD

CLAIM OF PRIORITY

This application claims priority from U.S. application Ser. No. 12/638,582, which was filed on Dec. 15, 2009 and is entitled "A Method of Removing Thermoset Polymer From Piezoelectric Transducers in a Print Head.".

TECHNICAL FIELD

This disclosure relates generally to inkjet ejectors that eject ink from a print head onto an image receiving surface and, more particularly, to print heads having inkjet ejectors comprised of multiple layers.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates perpendicular a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper, or a three dimensional object, such as an electronic board or bioassay.

FIGS. 4A and 4B illustrate one example of a single inkjet ejector 10 that is suitable for use in an inkjet array of a print head. The inkjet ejector 10 has a body 48 that is coupled to an ink manifold 12 through which ink is delivered to multiple inkjet bodies. The body also includes an ink drop-forming orifice or nozzle 14 through which ink is ejected. In general, the inkjet print head includes an array of closely spaced inkjet ejectors 10 that eject drops of ink onto an image receiving member (not shown), such as a sheet of paper or an intermediate member.

Ink flows from the manifold to nozzle in a continuous path. Ink leaves the manifold 12 and travels through a port 16, an inlet 18, and a pressure chamber opening 20 into the body 22, which is sometimes called an ink pressure chamber. Ink pressure chamber 22 is bounded on one side by a flexible diaphragm 30. A piezoelectric transducer 32 is rigidly secured to diaphragm 30 by any suitable technique and overlays ink pressure chamber 22. Metal and polymer film layers 34 that can be coupled to an electronic transducer driver 36 in an electronic circuit can also be positioned on both sides of the piezoelectric transducer 32.

Ejection of an ink droplet is commenced with a firing signal. The firing signal is applied across metal film layers 34 to excite the piezoelectric transducer 32, which causes the transducer to bend. Upon actuation of the piezoelectric transducer, the diaphragm 30 deforms to force ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

To facilitate manufacture of an inkjet array print head, an array of inkjet ejectors 10 can be formed from multiple laminated plates or sheets. These sheets are configured with a plurality of pressure chambers, outlets, and apertures and then stacked in a superimposed relationship. Referring once again to FIGS. 4A and 4B for construction of a single inkjet ejector, these sheets or plates include a diaphragm plate 40, an inkjet body plate 42, an inlet plate 46, an outlet plate 54, and an aperture plate 56. The piezoelectric-transducer 32 is bonded to diaphragm 30, which is a region of the diaphragm plate 40 that overlies ink pressure chamber 22.

One goal of print head design is to provide increasing numbers of inkjet ejectors in a print head. The more inkjet ejectors in a print head, the greater the density of the ink ejected and the perceived quality of the image. One approach to increasing inkjet ejector density in a print head is to locate the manifold external of the inkjet ejector. One way of implementing this approach includes providing an inlet in the diaphragm layer for each ejector. Coupling the inlet to the manifold to receive ink for ejection from the ejector, however, requires an opening in the piezoelectric-transducer layer to enable ink flow from the manifold to the inlet and then into the pressure chamber in the inkjet body plate. Each opening in the piezoelectric-transducer layer is located in a polymer portion in the interstices between the piezoelectric transducers.

In the assembly of previously known layered print heads having piezoelectric actuators, the process of mounting the layer containing the piezoelectric actuators and polymeric interstitial material to the diaphragm layer requires the use of a liquid thermoset polymer. This thermoset polymer spreads and enters the openings in the piezoelectric-transducer layer and the inlets in the diaphragm layer and then cures. The cured thermoset polymer then blocks the ink flow path into the inkjet ejector. Removal of the cured thermoset polymer from the ink inlets is difficult. To facilitate the removal of cured thermoset polymer from the inlets of the diaphragm plate, a print head assembly method has been developed that blocks the thermoset polymer from migrating past the diaphragm plate and enables the cured thermoset polymer to be removed from the inlets in the diaphragm plate by laser ablation. This method also makes possible the filling of the interstices between the piezoelectric transducers with thermoset polymer after the piezoelectric transducers have been mounted to the diaphragm plate. During this process, however, thermoset polymer reaches a level that covers an upper surface of the piezoelectric transducers and electrically isolates the transducers. This electrical isolation hinders the electrical connection of the piezoelectric transducers to the firing signals for operation of the print head.

SUMMARY

A method for mounting piezoelectric transducers to a diaphragm layer exposes an upper surface of each piezoelectric transducer after thermoset polymer has filled the interstitial space between the piezoelectric transducers. The method includes bonding a polymer layer to a diaphragm layer having a plurality of openings, bonding piezoelectric transducers to the diaphragm layer, filling areas between the piezoelectric transducers on the diaphragm layer with thermoset polymer, and removing the thermoset polymer from the piezoelectric transducers with a laser to expose a metal electrode on each piezoelectric transducer.

The method produces piezoelectric print heads with filled interstitial spaces that do not interfere with coupling the piezoelectric transducers to a firing signal circuit. The piezoelectric print head includes a body layer in which a plurality of pressure chambers is configured, a diaphragm plate having a plurality of openings, and a polymer layer interposed between the body layer and the diaphragm plate, a plurality of piezoelectric transducers bonded to the diaphragm plate with thermoset polymer, each piezoelectric transducer having an electrode exposed through a laser ablated opening in thermoset polymer extending between the piezoelectric transducers.

BRIEF DESCRIPTION OF THE DRAWINGS

The foregoing aspects and other features of exposing electrodes of piezoelectric transducers covered with thermoset polymer are explained in the following description, taken in connection with the accompanying drawings.

DETAILED DESCRIPTION

Figure 1A:
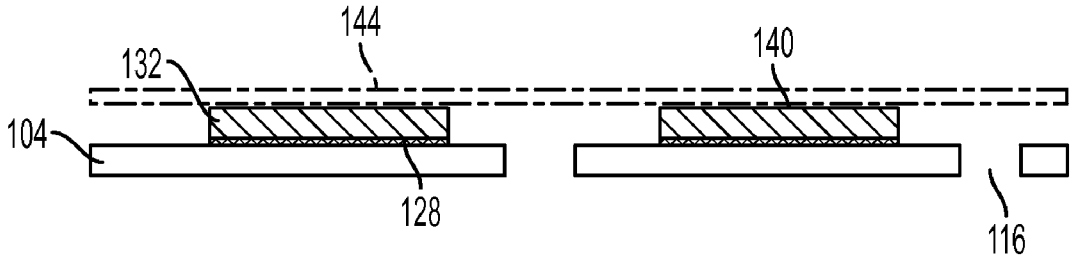
FIG. 1A is a profile view of a partially completed inkjet print head including a diaphragm layer, and piezoelectric transducers being bound to the diaphragm layer temporarily mounted on a carrier plate.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, etc. Devices of this type can also be used in bioassays, masking for lithography, printing electronic components such as printed organic electronics, and for making 3D models among other applications. The word "polymer" encompasses any one of a broad range of carbon-based compounds formed from long-chain molecules including thermoset polyimides, thermoplastics, resins, polycarbonates, and related compounds known to the art. The word "ink" can refer to wax-based inks known in the art but can refer also to any fluid that can be driven from the jets including water-based solutions, solvents and solvent based solutions, and UV curable polymers. The word "metal" may encompass either single metallic elements including, but not limited to, copper, aluminum, or titanium, or metallic alloys including, but not limited to, stainless steel or aluminum-manganese alloys. A "transducer" as used herein is a component that reacts to an electrical signal by generating a moving force that acts on an adjacent surface or substance. The moving force may push against or retract the adjacent surface or substance.

FIG. 1A depicts the bonding of the piezoelectric transducers to the diaphragm plate 104. The diaphragm plate 104 may be formed from a metal, glass, ceramic, or plastic sheet that has one or more ink ports 116 etched into its surface. The diaphragm plate should be thin enough to be able to flex easily, but also resilient enough to return to its original shape after it has been deformed. The piezoelectric transducers 132 are temporarily placed on a carrier plate 144, typically made of stainless steel. A thin layer of thermoset adhesive 128 is placed between the diaphragm plate and the transducers, and pressure and heat are applied to cure the adhesive and bond the transducers to the diaphragm plate. Once the bonding is completed, the carrier plate is removed. The piezoelectric transducers are now rigidly bonded to the diaphragm plate so that when one of the piezoelectric transducers deforms, the diaphragm plate deforms in the same direction.

Figure 1B:
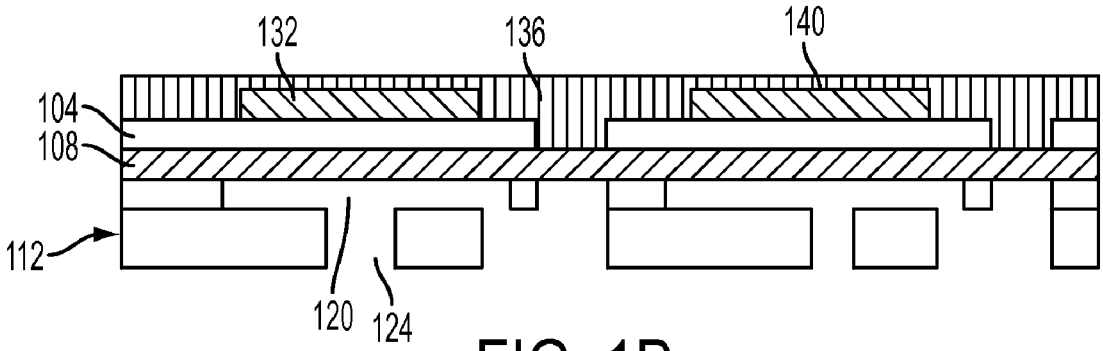
FIG. 1B is a profile view of a partial inkjet print head that shows the thermoset polymer covering the electrodes for the piezoelectric transducers.

FIG. 1B is a profile view of the same partial inkjet print head of FIG. 1A additionally including a polymer layer, a body layer, and an interstitial polymer layer formed between the piezoelectric transducers. The polymer layer 108 is bonded to the diaphragm plate first to form a seal with the diaphragm plate's ink ports. DuPont ELJ-100® is an example of a material that is suitable to form the polymer layer. The polymer layer may also be formed from a polyimide material or other polymers including polyetherether ketone, polysulfone, polyester, polyethersulfone, polyimideamide, polyamide, polyethylenenaphthalene, etc. The polymer layer can be a self-adhesive thermoplastic or have a thin layer of adhesive deposited on the side of the polymer layer that is placed in contact with the outlet plate. Alternatively, another thermoplastic or thermoset adhesive could be used to bond the polymer layer to the diaphragm.

The body layer is bonded to the opposite side of the polymer layer. The fluid path layer may be formed from one or multiple metal sheets that are joined via brazing as shown here as the body plate 111 and the inlet/outlet plate 112. The fluid path layer could also be made from a single structure molded, etched or otherwise produced. The fluid path layer contains openings or channels etched through the various layers that form paths and cavities for the flow of ink through the finished print head. A pressure chamber is structured with the diaphragm layer 104 and the polymer layer 108 forming the top portion, the body plate 111 and the inlet/outlet plate 112 forming the fluid body layer and providing the lateral walls and base of the pressure chamber. The chamber base has an outlet port 124 that allows ink held in the pressure chamber to exit the body layer when the diaphragm is deformed by a piezoelectric transducer (not shown).

Pressure and heat are applied to the polymer layer and body layer to bond the polymer layer to the body layer. In one embodiment having a thin thermoplastic adhesive layer, a pressure of 290 psi is applied at 350° C. for 30 minutes. After the diaphragm layer and the polymer layer are bonded together, an uncured thermoset polymer is used to fill the gaps between the piezoelectric transducers to form an interstitial layer 136. The thermoset polymer is cured to solidify the layer and a thin film of the cured thermoset polymer now covers or partially covers the piezoelectric transducers. The cured thermoset polymer electrically insulates the piezoelectric transducer's electrodes.

Using a laser beam and mask, a portion of the cured thermoset polymer is ablated to expose a portion of the metal surface of the piezoelectric transducers 132. The process is able to ablate a portion of the cured thermoset polymer covering a piezoelectric transducer's electrode, while also leaving the piezoelectric transducer intact. The mask may be a contact mask or a mask commonly used in photolithography, portions of which transmit the illuminating laser and portions of which block the laser light. The mask is aligned with the cured thermoset polymer 236 so that the mask passes the laser light from an imaging lens only on those areas where the cured polymer covers a piezoelectric transducer. For the contact mask, the beam illuminates the mask and transmits through the openings to ablate polymer from over the piezoelectric elements. For the lithography mask, the openings in the illuminated mask are imaged onto the piezoelectric elements to ablate material away. Additionally, the mask prevents cured thermoset polymer in the interstitial layer from being ablated and the interstitial layer surface is higher than the piezoelectric transducer surface as seen at corner 238 after the ablation is performed. This process cleans the surface of the piezoelectric transducer 140 (FIG. 2) to enable the transducer to be coupled to an electrical circuit in order to receive firing signals.

Figure 2:
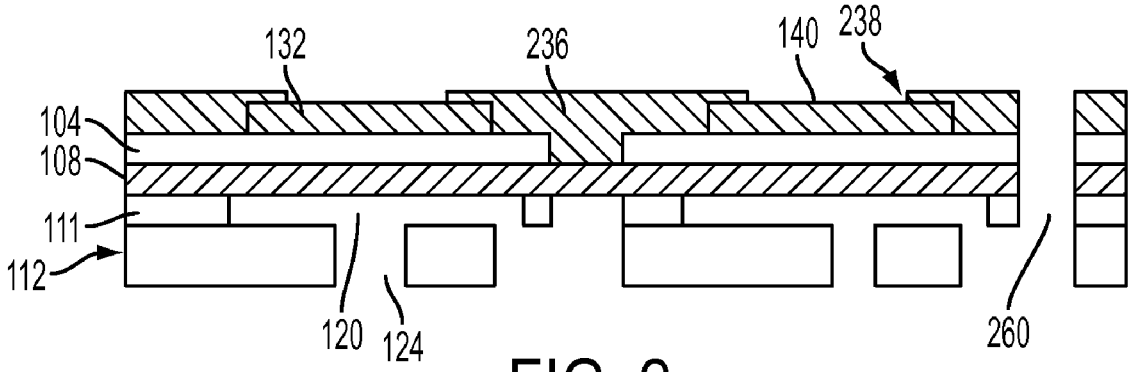
FIG. 2 is a profile view of the partial inkjet print head of FIG. 1B showing the exposure of the electrodes after laser ablation of the cured thermoset polymer.

While any laser capable of ablating the polyimide film without damaging the piezoelectric transducer intact may be used, one possible embodiment uses an excimer laser having a wavelength of 248 nm or 308 nm. Such a laser might operate at 10 Hz to 1 kHz and typically at 50 Hz with laser fluence in the range 200 mJ/cm$^2$ to 800 mJ/cm$^2$ and typically at 500 mJ/cm$^2$. These relatively low frequencies are used to help ensure that metal surfaces of the electrodes are not damaged. The laser light scans across the mask to ensure that all of the piezoelectric transducers are fully etched to remove the cured polymer and expose the metal electrode of the transducer for electrical connection. One embodiment sweeps the laser in a series of rows across the mask, with the laser starting at the beginning of the row, moving the laser across the mask, and then moving to the start of the next row. This process is repeated until the entire mask has been exposed. After the metal layer of each transducer is exposed, an opening for an ink inlet 260 in the partial inkjet print head is formed by another laser ablation process. As shown in FIG. 2, inlet 260 shows one ink port in the diaphragm layer 104 with the cured thermoset polymer 236 and polymer layer 108 removed to enable ink to flow through the ink inlet and another ink port blocked by the cured thermoset polymer 236 and polymer layer 108. The laser ablation process opens each ink inlet in the diaphragm layer. FIG. 2 simply illustrates a blocked and cleared ink port.

Figure 3:
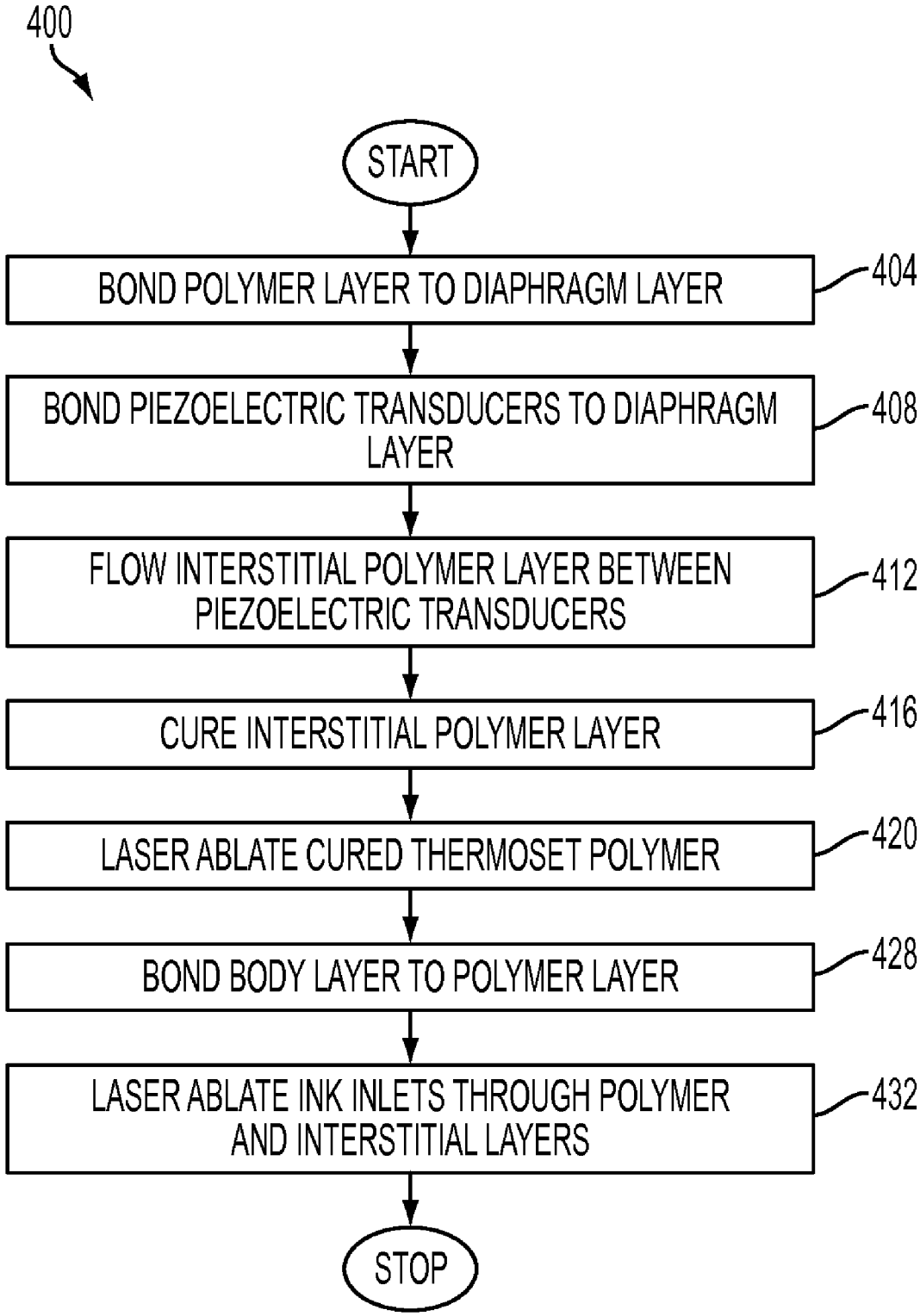
FIG. 3 is a flow diagram of a method of assembling the partial inkjet print head shown in FIG. 2.
Figure 4A:
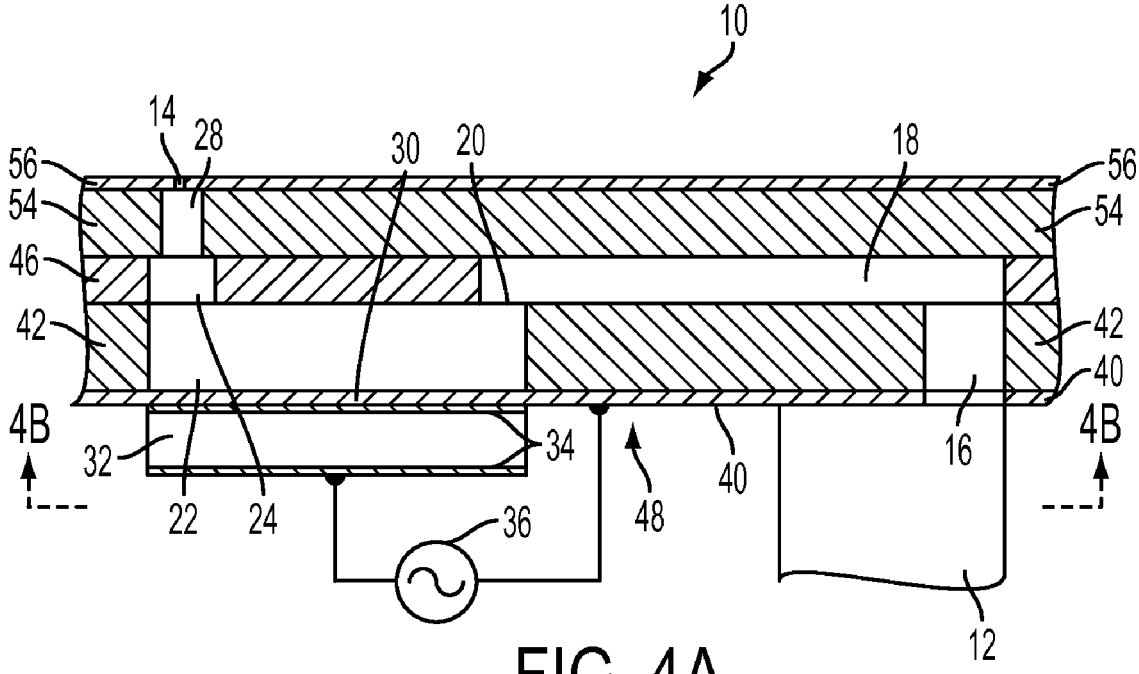
FIG. 4A PRIOR ART
FIG. 4A is a schematic cross-sectional side view of a prior art embodiment of an inkjet.
Figure 4B:
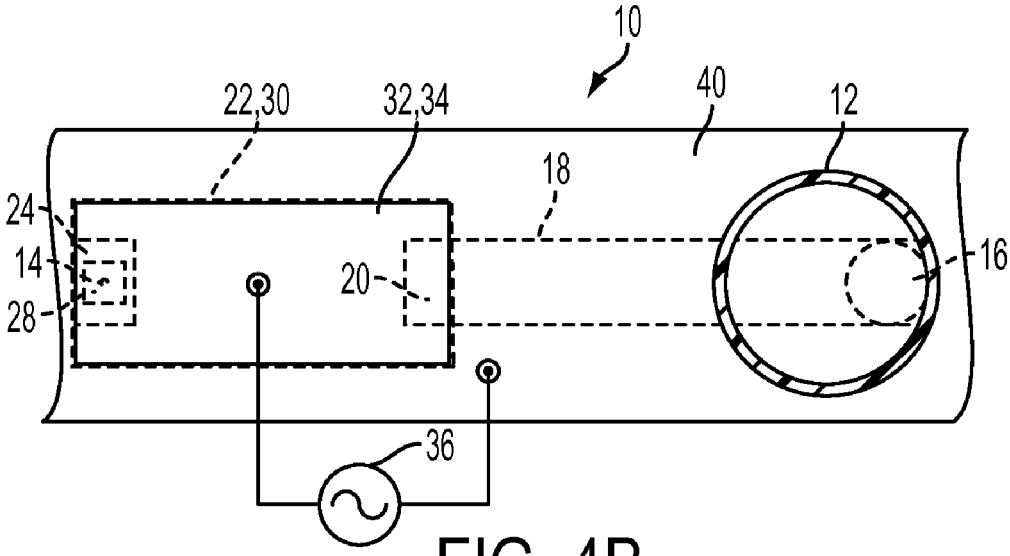
FIG. 4B PRIOR ART
FIG. 4B is a schematic view of the prior art embodiment of the inkjet of FIG. 4A.

FIG. 3 is a flow diagram of a method 400 of assembling the partial inkjet print head disclosed herein. First, the piezoelectric transducers are temporarily affixed to a stainless steel carrier plate, and are pressed to a diaphragm layer (block 404). The diaphragm layer has ink inlets etched through it with one ink port corresponding to each piezoelectric transducer. A thermoset polymer bonds the piezoelectric transducers to the diaphragm layer and then the carrier plate is removed. Next, a polymer layer is bound to the diaphragm layer on the side opposite the piezoelectric transducers (block 408). Then, a metallic body layer may be bound to the polymer layer on the side opposite the diaphragm layer (block 412), although this portion of the process may be performed later. A liquid thermoset polymer is poured into the gaps between the piezoelectric transducers, where it also flows into the ink ports of the diaphragm layer and collects on the polymer layer (block 416). The liquid interstitial polymer layer is then cured, producing a solid interstitial layer (block 420), a thin film of which covers or partially covers the metal electrodes on the piezoelectric transducers. Next, the piezoelectric transducer electrodes are cleaned of electrically insulating polymer via a laser ablation process (block 428). Two possible cleaning methods are used. In one, a photolithographic mask enables a laser to ablate only the polymer thin film covering the piezoelectric transducers. In the other process, a scanning laser is used with a contact mask to remove the cured thermoset polymer from the piezoelectric transducers. Finally, a laser ablation process opens ink inlets by ablating the cured thermoset polymer and interstitial polymer layers for each ink inlet in the print head (block 432).

In operation, ink flows through the ink inlet 260 and into the pressure chamber 120. An electrical firing signal applied to the piezoelectric transducer 132 causes the piezoelectric transducer to bend, deforming the diaphragm 104 and polymer layer 108 into the pressure chamber. This deformation urges ink out the outlet port 124, into openings in an aperture plate (not shown) where the ink exits the print head as a droplet. After the ink droplet is ejected, the chamber is refilled with ink, with the piezoelectric transducer aiding the process by deforming in the opposite direction to cause the concomitant movement of the diaphragm and polymer layer that draw ink into the pressure chamber.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for bonding a piezoelectric transducer layer with a diaphragm layer comprising:

bonding a polymer layer to a diaphragm layer having a plurality of openings;

bonding piezoelectric transducers to the diaphragm layer;

filling areas between the piezoelectric transducers on the diaphragm layer with thermoset polymer; and removing the thermoset polymer from the piezoelectric transducers with a laser to expose a metal electrode on each piezoelectric transducer.

2. The method of claim 1, the thermoset polymer removal further comprising:

placing a contact mask over the piezoelectric transducers; and illuminating the contact mask with a scanning laser.

3. The method of claim 1, the thermoset polymer removal further comprising:

imaging a laser illuminated lithography mask on the thermoset polymer to ablate the thermoset polymer from the top surface of the piezoelectric transducers.

4. The method of claim 1 wherein the laser is an excimer laser.

5. The method of claim 1 wherein the laser has a wavelength of 248 nm or 308 nm.

6. The method of claim 5 wherein the laser operates between 10 Hz and 300 Hz with a laser fluence between 200 mJ/cm$^2$ and 800 mJ/cm$^2$.

7. The method of claim 1, the filling of the areas between the piezoelectric transducers with thermoset polymer includes:

flowing the thermoset polymer into the areas between the piezoelectric transducers; and curing the thermoset polymer before the laser ablation is performed.

8. The method of claim 1 wherein the polymer layer is interposed between the diaphragm layer and a body layer in which a plurality of pressure chambers is configured.

9. A method for mounting a piezoelectric transducer layer to a diaphragm layer comprising:

bonding a polymer layer to a diaphragm layer having a plurality of openings;

bonding piezoelectric transducers to the diaphragm layer;

flowing thermoset polymer in areas between the piezoelectric transducers bonded to the diaphragm layer with thermoset polymer;

curing the thermoset polymer; and ablating the cured thermoset polymer from a portion of each piezoelectric transducer with a laser to expose an electrode for each piezoelectric transducer.

10. The method of claim 9, the laser ablation further comprising:

placing a mask over the piezoelectric transducers and the thermoset polymer before the laser ablation is performed.

11. The method of claim 10, the thermoset polymer ablation further comprising:

placing a contact mask over the piezoelectric transducers; and illuminating the contact mask with a scanning laser.

12. The method of claim 10, the thermoset polymer ablation further comprising:

imaging a laser illuminated lithography mask on the thermoset polymer to ablate the thermoset polymer from the top surface of the piezoelectric transducers.

13. The method of claim 9 wherein the laser is an excimer laser.

14. The method of claim 9 wherein the laser has a wavelength of 248 nm or 308 nm.

15. The method of claim 14 wherein the laser operates between 10 Hz and 300 Hz with a laser fluence between 200 $mJ/cm^2$ and 800 $mJ/cm^2$.

16. The method of claim 9 wherein the polymer layer is interposed between the diaphragm layer and a body layer in which a plurality of pressure chambers is configured.

* * * * *